US005886476A

United States Patent [19]

Skinner et al.

[11] Patent Number: 5,886,476

[45] Date of Patent: Mar. 23, 1999

[54] METHOD AND APPARATUS FOR PRODUCING ELECTRICAL DISCHARGES

[75] Inventors: Albert Anthony Skinner, Anderson; Douglas Lynn Sprunger, Middletown; Scott Ray Hummel, Anderson, all of Ind.

[73] Assignee: General Motors Corporation, Detroit, Mich.

[21] Appl. No.: 884,296

[22] Filed: Jun. 27, 1997

[51] Int. Cl.[6] ..... H05B 37/02

[52] U.S. Cl. ..... 315/209 T; 315/209 R; 361/253; 123/406

[58] Field of Search ..... 315/209 T, 209 CD, 315/209 R; 361/253, 256, 257, 263, 249; 123/406, 637

[56] References Cited

U.S. PATENT DOCUMENTS 3,892,219 7/1975 Preiser et al. ..... 315/209 T X
3,913,550 10/1975 Canup ..... 315/209 T X
3,945,362 3/1976 Neuman et al. ..... 315/209 T X
5,097,815 3/1992 Oota et al. ..... 315/209 T X
5,636,620 6/1997 Kiess et al. ..... 123/625
5,638,799 6/1997 Kiess et al. ..... 123/637

*Primary Examiner*—Don Wong
*Assistant Examiner*—Haissa Philogene
*Attorney, Agent, or Firm*—Vincent A. Cichosz

[57] ABSTRACT

A dual primary, single secondary ignition coil and control provides for establishment of a continuous extended arc across a pair of electrodes or dual arcs across the pair of electrodes. Continuous extended arcs are advantageous in extended burn applications and dual arcs are advantageous in gas plasma ion sense misfire detection applications.

18 Claims, 5 Drawing Sheets

METHOD AND APPARATUS FOR PRODUCING ELECTRICAL DISCHARGES

TECHNICAL FIELD

The present invention is related to spark ignition systems.

BACKGROUND OF THE INVENTION

Conventional single strike ignition systems for producing a combustion arc across electrodes of a spark plug disposed within a combustion chamber are well known. The predominant application for such systems is timed combustion of a compressed fuel charge in a combustion cylinder of an internal combustion engine. Ignition systems conventionally employ an ignition coil which provides an auto-transformer function to generate a high voltage across the electrodes of a spark plug sufficient to result in the desired combustion arc. Known ignition systems may employ a single ignition coil with mechanical or electronic distribution of the high voltage sequentially to multiple spark plugs in a multi-cylinder engine. So called distributorless concurrent discharge ignition systems are known in which pairs of combustion cylinders share a single ignition coil and its high-voltage output. The one of the cylinders undergoing compression of a fuel charge is said to receive a combustion spark while the other of the cylinders undergoing exhaust of gases is said to receive a waste spark. Another known variety of distributorless ignition systems is may be referred to as a coil at plug or coil near plug. As the name suggests, the coil at plug systems have a coil associated with each cylinder of a multi-cylinder internal combustion engine and are characterized by packaging challenges due to the desired proximal placement of the ignition coil to the spark plug.

Generally, desirable objectives of any internal combustion engine ignition system is to maximize the energy delivered across the electrode gaps of the spark plugs and to increase the time of the discharge or burn time. Such an objective has the benefit of extending the combustion process for more complete burn. However, the relationship between energy delivered and ignition coil size is generally one of direct correspondence. Increase in ignition coil size is generally disadvantageous or impractical since mass is likely to also increase as is packaging difficulty particularly with respect to distributed ignition systems and most notably with respect to coil at plug systems in which available space for the coils is significantly limited.

Another shortfall of high burn time ignition coils in general relates to the turns ratio of the secondary to primary winding. Typically, high burn time ignition coils require a relatively high turns ratio. This may be problematic as a breakdown voltage induced across the secondary winding, and hence across the gapped electrodes, may be reached at the beginning of the primary charging prior to the desired ignition timing. Early breakdown voltages yield undesirable premature light-off of the fuel charge or, alternatively stated, ignition on make. Additional secondary winding circuitry in the form of expensive high-voltage blocking diodes are therefore commonly introduced to block ignition on make in high turns ratio ignition coils.

AC ignition systems are also known for providing extended burn benefits but typically employ expensive DC-DC converters at the input to raise the input voltage to a level providing adequate performance of the ignition coil in both transformer and induction modes. Additionally, and consistent with size and mass minimization objectives, high switching frequency DC-DC converters are used which may produce undesirably high levels of radio frequency (RF) interference.

Dual strike ignition systems are also known for producing a first combustion arc across electrodes of a spark plug disposed within a combustion cylinder followed by a second arc across the electrodes. The second arc may be characterized as a secondary combustion arc when used for the purpose of extending the burn, or may be characterized as a measurement arc when used for the purpose of detecting misfire in conjunction with a plasma induced misfire detection system. Co-pending U.S. patent application Ser. Nos. 08/651,416 and 08/651,320 also assigned to the Assignee of the present invention disclose an exemplary dual strike ignition system and plasma induced misfire detection system. Such exemplary systems, while providing improvements to the art, may require high turns ratios subject to ignition on make events. Additionally, such systems provide for discontinuous or piecemeal introduction of energy into the ignition process.

SUMMARY OF THE INVENTION

The present invention provides a dual primary ignition coil in which each respective primary is independently energized to establish magnetic fields of opposite polarity. A single secondary winding is inductively coupled to the primary windings and has opposite ends coupled to a pair of electrodes. A first one of the primary windings is first energized and deenergized to induce a breakdown voltage across the pair of electrodes and create an electrical arc thereacross. The second one of the primary windings is next energized subsequent to the deenergization of the first primary winding and thereafter deenergized to create an electrical arc across the pair of electrodes. The deenergization of the second primary winding may occur prior to the extinguishment of the first primary winding induced arc whereby a continuous arcing is established. The deenergization of the second primary winding may occur subsequent to the extinguishment of the first primary winding induced arc whereby a separate arc is established. A variety of criteria may be used in establishment of the energization and deenergization of the first and second primary windings including delay times and winding currents.

DESCRIPTION OF THE PREFERRED EMBODIMENT

Figure 1:
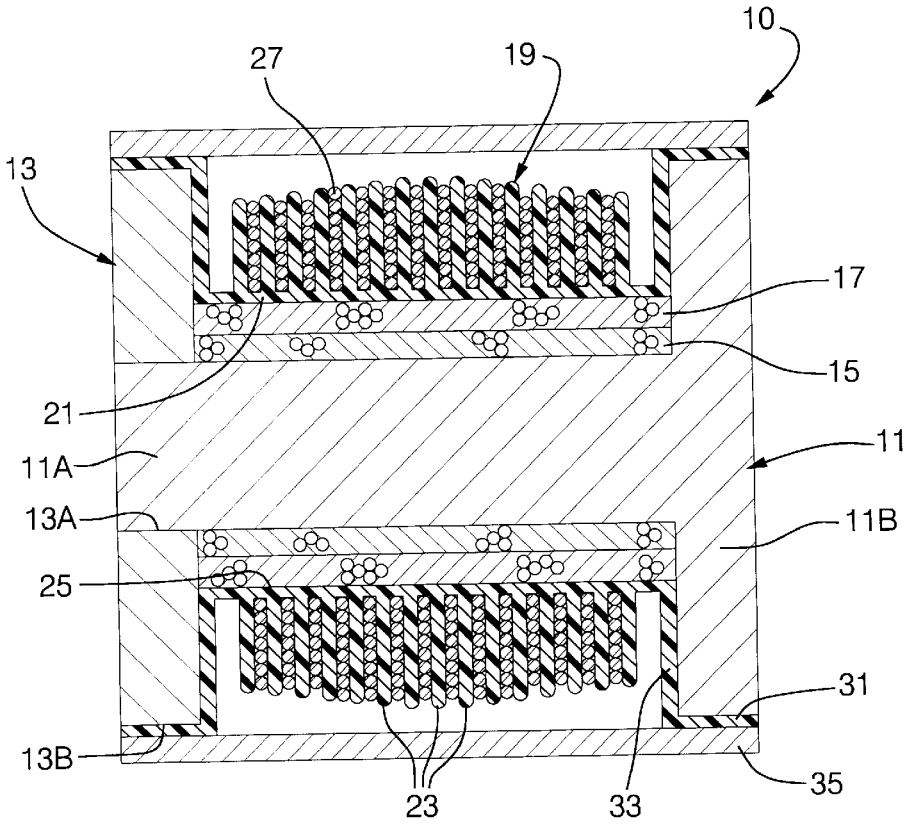
FIG. 1 schematically illustrates in section an ignition coil adapted for implementing the present invention.

Various labels may be used throughout the figures and it is to be understood that similar features appearing in multiple figures may be identified with the same labels. With reference first to FIG. 1, a dual strike ignition coil is generally designated with the numeral 10. Ignition coil 10 includes two magnetic parts 11 and 13. Magnetic part 11 has an axially extending core 11A that is integral with an end wall 11B. Magnetic part 13 is formed as an annulus or apertured disk forming a circular outer wall 13B and an inner wall 13A. The axially extending core 11A of magnetic part 11 is shaped and sized, at least with respect to the distal end, to fit within the aperture formed by inner wall 13A of magnetic part 13. The inner wall and axially extending core are dimensioned to engage with an interference fit. The aperture and corresponding axially extending core 11A are preferably circular in cross section. Other shapes such a hexagonal cross sections may be employed.

Magnetic parts 11 and 13 are preferably formed from a plastic coated iron powder in a compaction molding process. The particles of iron are coated with an insulating plastic which binds the particles together and forms an insulating layer to provide gaps, like air gaps, between the particles.

The dual strike ignition coil includes an inner primary winding 15 wound directly on the axially extending core 11A of magnetic part 11. The inner primary winding 15 may comprise two winding layers each comprising 41 turns of No. 24 AWG wire for a total of 82 turns. The dual strike ignition coil also includes an outer primary winding 17 wound directly on the first primary winding. The outer primary winding 17 comprises four winding layers comprising 41 turns of No. 24 AWG wire for a total of 164 turns. Both of the primary windings may be wound in the same or opposite directions. Both of the primary windings may also be interchanged with respect to their relative inner and outer placements. Additionally, both primary windings may be wound directly on adjacent portions the core 11A such that the primary windings are axially adjacent. Hereafter, the primary winding designated as the inner winding 15 may be referred to as the second primary winding and the primary winding designated as the outer primary winding may be referred to as the first primary winding for reasons which will become more apparent later in the description of operation.

The ignition coil has a secondary winding unit 19 that is disposed about the primary windings 15 and 17. The secondary winding unit comprises a one-piece spool 21 that is molded from a plastic insulating material. Spool 21 is formed with a plurality of axially spaced, radially extending ribs 23 extending circumferentially about the spool from a base portion 25. The ribs 23 provide for winding slots for a segmented secondary winding. While the base portion 25 of spool 21 is shown having substantially consistent cross section, it may be desirable that one or both axial ends taper down toward the opposite end. In one sided ignition coil applications wherein a single spark plug is serviced by the high voltage secondary winding, the high voltage end of the secondary winding would be wound upon the thickest cross sectional portion of the base. The tapered base may advantageously provide for necessary electrical gapping between the high voltage end of the secondary winding and the core 11A of magnetic part 11. For similar reasons in two sided ignition coil applications wherein a pair of spark plugs are serviced by opposite ends of the high voltage secondary winding, the ends of the secondary winding would be wound upon the thickest cross sectional portions of the base. In the present embodiment, however, the coil turns ratio is such that a simple non-tapered cross sectional base provides for adequate insulation at minimal spacing from the core 11A.

The secondary winding in the illustrated embodiment is labeled 27 and by way of example may comprise a total of 9840 turns of No. 42 AWG wire. In the illustrated embodiment having 14 slots and a corresponding number of segmented windings, the winding turns may be distributed from the one end slot in succession to the other end slot as follows: slots 1–9, 849 turns; slot 10, 677 turns; slot 11, 592 turns; slot 12, 465 turns; slot 13, 296 turns; and slot 14, 169 turns. It will be appreciated that all 14 segmented windings are connected in series by cross-over connections that extend through slots in ribs 23. The turns ratios for the secondary winding to the first primary winding and second primary winding are approximately 60 and 120, respectively.

The spool 21 has a plurality of integral spacers 31 which extend axially from a corresponding plurality of radial arms 33. Integral spacers 31 provide a predetermined spacing, or air gap, between the magnetic parts 11, 13 and an outer flux return shield 35, also formed from a magnetic material. Flux return shield is disposed about the secondary winging unit 19. Flux return shield 35 provides a flux path for flux produced by the primary windings and as a shield.

The description of the dual strike ignition coil 10 set forth above is but one example of a general variety of an ignition coil adapted for dual strike application in accordance with the dual primary winding feature of the present invention. It is envisioned that the described coil be incorporated into an ignition module with other like ignition coils and ignition timing controls. Alternative dual strike ignition coils may be adapted from coil at plug ignition coils such as disclosed for example in co-pending U.S. patent application Ser. No. 08/763,574 also assigned to the assignee of the present invention.

Figure 2:
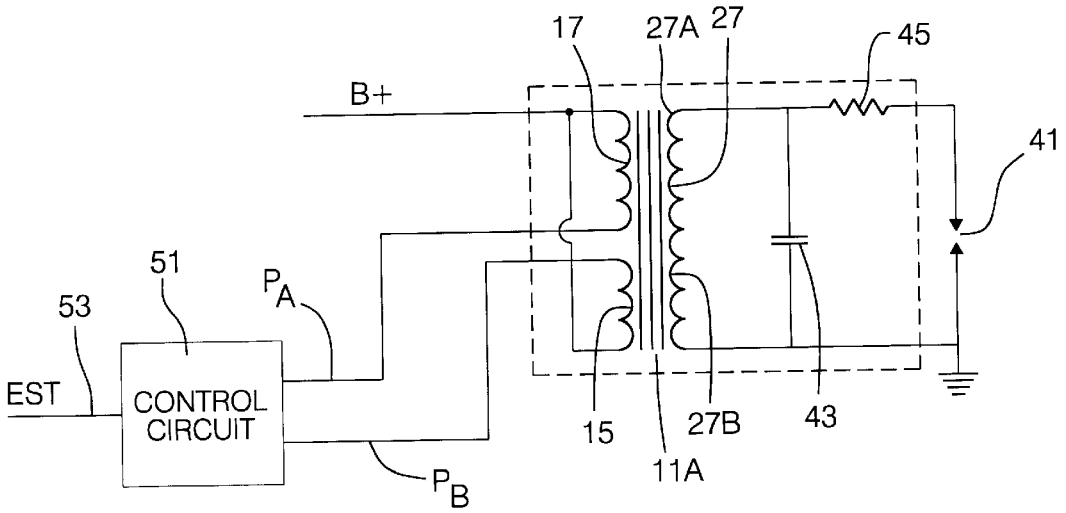
FIG. 2 is an electrical schematic illustration of an ignition apparatus in accord with the present invention.

With reference now to FIG. 2, a two primary winding ignition coil as generally described is illustrated in electrical schematic as part of a one sided ignition apparatus servicing a single set of gapped electrodes 41 such as associated with a single combustion cylinder of an internal combustion engine (not shown). Further detailing the secondary winding 27 are labels 27A and 27B corresponding to high-voltage and low-voltage ends, respectively. In the present embodiment for extended burn applications, it is assumed that the low-voltage end 27B is coupled directly to a common ground or chassis ground of an automobile in conventional fashion. In application to plasma induced misfire detection, the low-voltage end 27B would be, for example, coupled to ground through a tuned resonant network adapted to detect the presence of certain frequency content in the secondary winding indicative of combustion in the cylinder. In either application, the high-voltage end 27A of ignition coil 27 is coupled to one electrode of gapped electrodes 41 through conventional means. For example, spark plug wire in remote applications, and extended plug boot and conductor in top-of-plug applications. The other electrode of gapped electrodes 41 is also coupled to a common ground, conventionally by way of threaded engagement of the spark plug to the engine block.

As earlier mentioned in description of the primary windings of the dual primary ignition coil, the windings may be wound in the same or opposite directions about the core. In the illustration of FIG. 2, it is assumed that the two primary windings 17 and 15 are wound in the same direction. Since one of the objectives in controlling the apparatus is to provide for respective energizations of the primary windings to produce opposite polarity magnetic fields in the magnetic circuit, the common energizing potential B+ is shown coupled to opposite ends of the respective primary windings. Such coupling together with the assumed same direction winding pattern produces the desired opposite magnetic polarity through the magnetic circuit. The respective ends of the primary windings not coupled to the common energizing potential B+ are coupled to control circuit 51 by lines labeled $P_A$ and $P_B$. The common energizing potential B+ is, in the present embodiment, assumed to correspond to conventional automotive system voltage in a nominal 12 volt automotive electrical system. Typically, common energizing potential B+ is coupled by way of an operator manipulated ignition switch which is hot in conventional start and run positions.

Control circuit 51 is responsive to electronic spark timing (EST) signals on line 53 to selectively couple the primary windings 17 and 15 to system ground through lines $P_A$ and $P_B$, respectively. EST signals provide a conventional ignition timing control information from, for example, a conventional microprocessor engine control unit responsive to well known engine parameters for controlling engine functions including, in addition to ignition functions, engine fueling, exhaust emissions and diagnostics. EST signals are well understood to set dwell duration and spark timing relative to cylinder stroke angle. Such microprocessor based controllers are also conventionally integrated with electronic transmission control functions to complete an integrated approach to powertrain control. Alternatively, some of the functions including ignition timing may be off-loaded from the central engine controller and incorporated into the ignition module. In such a latter case, the EST signals, as well as other ignition control signals, particularly cylinder selection signals where appropriate, would be implemented by the separate ignition module.

In operation, the control circuit 51 is operative, in accordance with one embodiment having the objective of providing an extended continuous high-energy arc across the gapped electrode, to sequentially force current through the first primary winding 17 in accordance with the predetermined dwell time and to interrupt the current therethrough to cause initiation of a first combustion arc across the gapped electrodes. At a predetermined point subsequent to the interruption of current through the first primary winding 17, current is forced through the second primary winding 15. The opposite polarity arrangement of the two primaries drives the magnetic flux into the third quadrant of the B-H curve as the second primary winding 15 current rises. After a predetermined dwell and prior to expiration of the first combustion arc, the current through the second primary winding 15 is interrupted to cause initiation of a second combustion arc of opposite polarity to the first combustion arc. An important feature of the presently described continuous burn embodiment is that the first combustion arc is not extinguished prior to the initiation of the second combustion arc thereby providing continuous uninterrupted introduction of energy into the burn process.

Alternatively, in accordance with another embodiment having the objective of providing a measurement arc across the gapped electrode, current through first primary winding 17 is manipulated in the same fashion to cause initiation of a combustion arc across the gapped electrodes. At a predetermined point subsequent to the interruption of current through the first primary winding 17, current is forced through the second primary winding 15. The opposite polarity arrangement of the two primaries drives the magnetic flux into the third quadrant of the B-H curve as the second primary winding 15 current rises. After a predetermined dwell and subsequent to expiration of the combustion arc, the current through the second primary winding 15 is interrupted to cause initiation of a measurement arc of opposite polarity to the combustion arc and after the combustion arc has extinguished. An important feature of the presently described plasma induced misfire detection embodiment is that the first combustion arc is extinguished prior to the initiation of the measurement arc thereby providing the requisite separate arc. Another advantage brought out by the plasma induced misfire detection embodiment is an extension of the combustion arc by the energizing of the second primary winding 15 thereby introducing higher energy levels during the burn process while the second primary winding 15 stores energy for initiation of a subsequent measurement arc.

In accordance with a preferred embodiment of a control circuit 51 as shown in FIG. 2, and adaptable for implementing either a second combustion arc in a continuous burn application or a measurement arc in an plasma induced misfire detection application, a circuit is illustrated having output lines PA and PB which are controllably driven to a grounded current sinking state or an open current blocking state. EST signals are provided on line 53 for initiating a sequence of dual discharge arcs. As previously mentioned, EST signals may be generated by a conventional engine controller. The EST signal line 53 is shown dedicated to the one ignition coil in the example and hence is assumed to provide the requisite spark timing information only for the particular cylinder being serviced by the one ignition coil. Therefore, a separate EST signal line similar to the one illustrated in the present embodiment would be required for each additional ignition coil in a complete ignition system. Alternatively, though not separately illustrated, a single EST signal line may provide the requisite spark timing information for multiple ignition coils provided an appropriate cylinder selection signal is made available to gate the EST signals to the appropriate ignition coil hardware as well known to those skilled in the art.

Figure 3A:
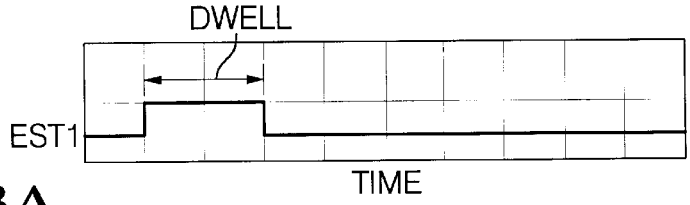
FIGS. 3A through 3G illustrate certain characteristic signals at various points in the exemplary apparatus as illustrated in FIGS. 2 and 4.
Figure 3B:
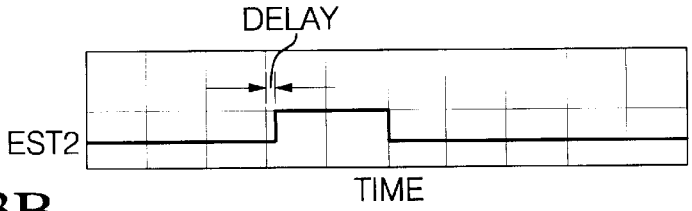
Figure 3C:
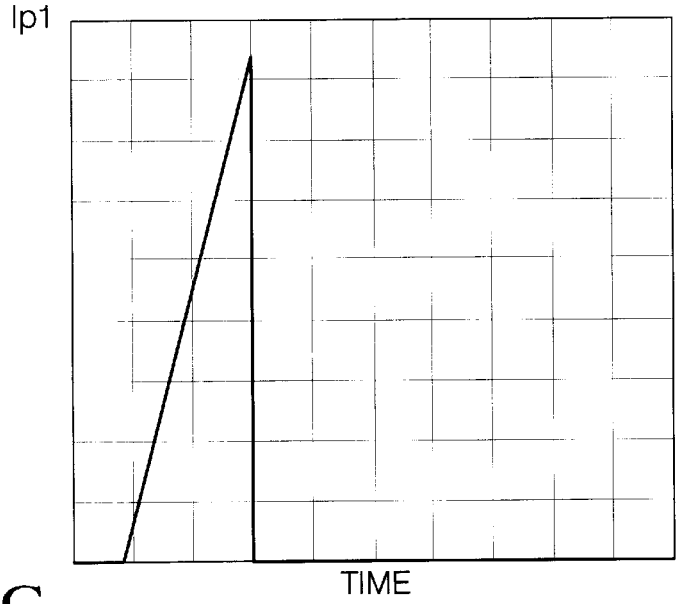
Figure 3D:
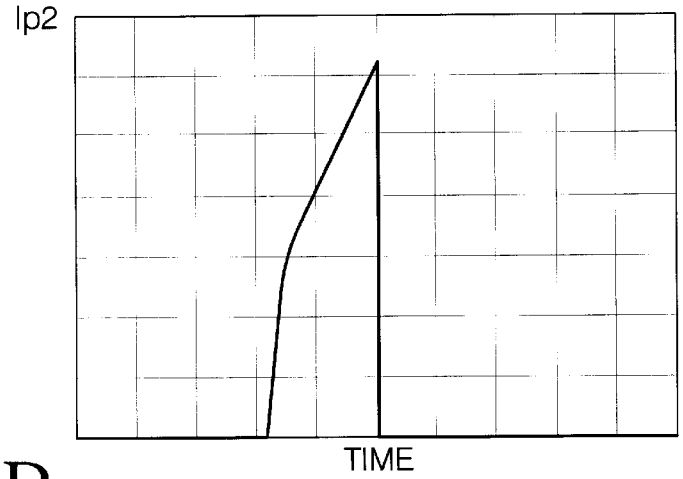
Figure 3E:
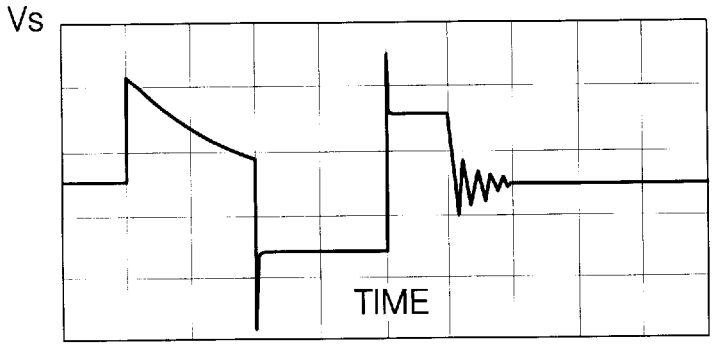
Figure 3F:
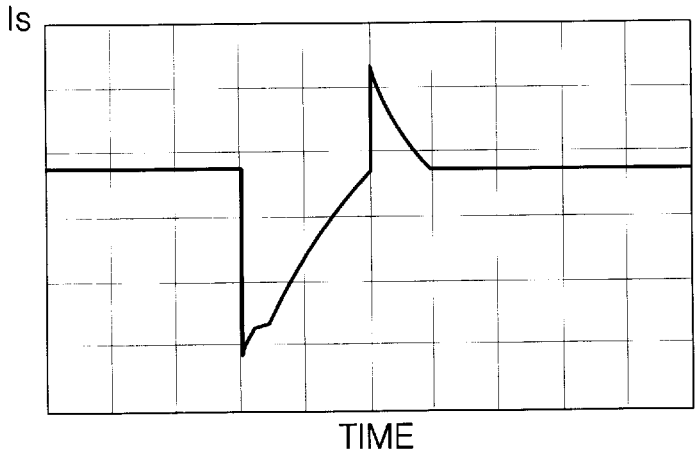
Figure 3G:
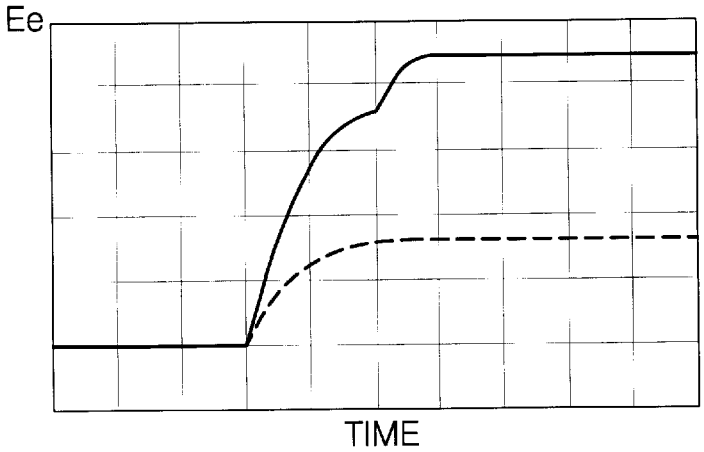
Figure 4:
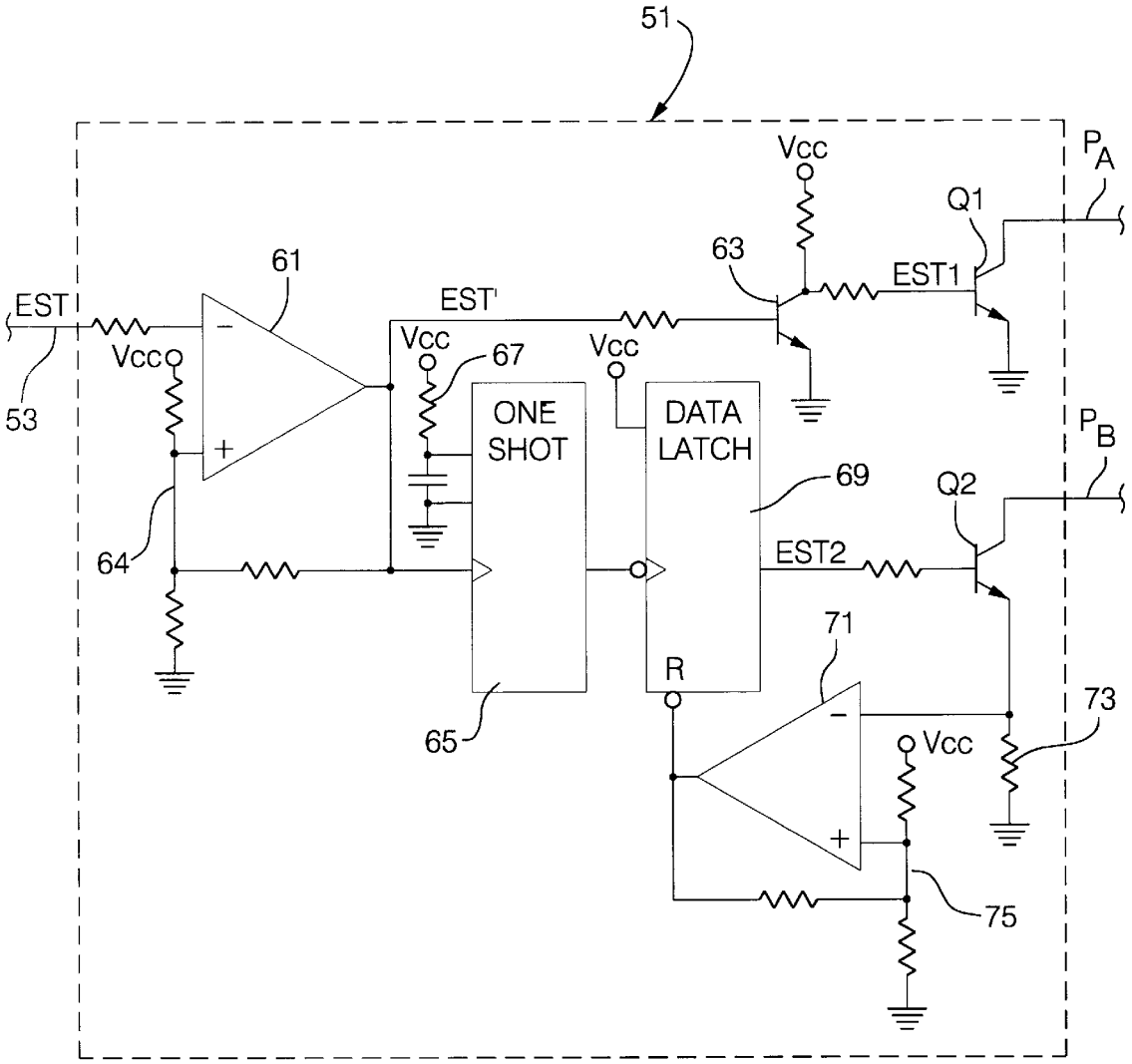
FIG. 4 is an electrical schematic of a preferred control circuit for implementing the multiple electrical discharges in accord with the present invention.

The various traces of FIGS. 3A through 3G may be referred to during the following description of the circuit of FIG. 4 and its operation. A first inverting comparator 61 receives the EST signals from line 53 at its inverting input. The non-inverting input of comparator 61 is coupled to a predetermined threshold voltage supplied by a threshold network 64 and regulated voltage source $V_{CC}$. The non-inverting input is also coupled in feedback to the comparator 61 output through a hysteresis setting resistor for stabilization. The output of the comparator 61 is substantially an inverted EST signal and is labeled EST' in the figure. EST' signal is used to bias switching transistor 63 in an inverting stage of the circuit to establish EST1 signal as shown also in FIG. 3A. EST1 signals essentially follow the EST signals. EST1 signals in turn control the ground driver Q1 which provides a high current sink when switched on by a high EST1 signal and interrupts the current path when switched off by a low EST1 signal. Ground driver Q1 may take any appropriate variety including darlington pair configurations and IGBTs. The high and low EST1 signal states correspond to current delivery and current interruption, respectively, through the first primary winding 17.

With reference back to the output of comparator 61, the output is also provided to a conventional positive edge triggered one shot 65. One shot 65 may take any well known form including well known 555 timer apparatus. One shot positive pulse duration is set in accordance with an external RC network 67 in the present implementation. The one shot positive pulse duration corresponds to a desired delay between the interruption of current through the first primary winding 17 corresponding to the negative going edge of EST1 signal (positive going edge of EST') and the energization of the second primary winding 15. In the present embodiment directed toward providing a continuous burn application, a one shot pulse width—and hence a delay—of substantially 0.06 milliseconds is chosen.

The output from one shot 65 provides the input to a conventional negative edge triggered data latch 69 whose output is set high upon the expiration of the one shot 65 output. This data latch output provides a second EST signal labeled EST2 in FIG. 4 and FIG. 3B. EST2 signal is provided to ground driver Q2 which provides a high current sink when switched on by a high EST2 signal and interrupts the current path when switched off by a low EST2 signal. Ground driver Q2 may take any appropriate variety including darlington pair configurations and IGBTs. The current interruption instant is determined in the present example by a second primary 15 current sense circuit comprising an inverting comparator 71 and a voltage threshold network 75 of resistors coupled between regulated voltage $V_{CC}$ and ground. The ground driver is coupled between the second primary and current sense resistor 73. As the current through the second primary winding 15 reaches a predetermined level in excess of the threshold voltage at the non-inverting input of the comparator, the voltage across the current sense resistor 73 and hence the input voltage to the inverting input of the comparator provides a low output at the comparator.

The characteristic response of the ignition coil to the EST1 and EST2 signals as described is shown in FIGS. 3C through 3G wherein Ip1 and Ip2 correspond to the currents through the first and second primary windings, respectively; Vs corresponds to the voltage across the secondary coil and hence across the gapped electrodes; Is corresponds to the current through the secondary winding and hence arcing across the gapped electrodes; and, Ee corresponds to the energy delivered to the burn as the simple integration of Vs and Is over time. All of the FIGS. 3A through 3G are illustrated along a common horizontal time axis. As can be seen from examination of FIGS. 3A through 3G, the invention practiced in accordance with the embodiment described provides increasing current Ip1 (FIG. 3C) through the first primary winding during the dwell period of EST1 (FIG. 3A). The induced secondary winding voltage (FIG. 3E) during dwell remains sufficiently low to avoid spark on make (FIG. 3F). Upon interruption of the current Ip1 through the first primary winding, the secondary voltage polarity reverses and exceeds the breakdown voltage (FIG. 3E) causing the initiation of the first combustion arc as shown by the negative polarity current Is (FIG. 3F). After the delay (FIG. 3B), the current Ip2 is developed through the second primary winding (FIG. 3D) which pushes the magnetic flux through the third quadrant of the B-H curve extending the combustion arc (FIG. 3F) and storing magnetic energy in the core for discharge through a second combustion arc at the interruption of the primary current Ip2 through the second primary winding.

The control circuit in the present embodiment senses the second primary current Ip2 to determine the appropriate level at which the current interruption is desirably invoked. In a continuous burn application, that point preferably is prior to the secondary current Is decay to zero (FIG. 3F), or alternatively stated preceding the extinguishment of the first combustion arc. Upon the interruption of the second primary winding current Ip2 (FIG. 3D), the secondary voltage polarity again reverses (FIG. 3E) causing the initiation of the second combustion arc as shown by the positive polarity current Is (FIG. 3F). With specific reference to FIG. 3G, the energy delivered by apparatus as described is graphically depicted by the solid trace of the figure. The broken line trace in the figure represents the energy delivered from a conventional single primary ignition coil having the same turns ratio and dwell parameters. The relative relationship is substantially representative of the results obtained by the inventors through experimental analysis of a dual primary coil and EST timing as described herein. In absolute values, the single primary ignition coil dissipated approximately 27 millijoules across the gapped electrodes in contrast to approximately 84 millijoules of energy in the case of the dual primary ignition coil described with only a relatively modest volumetric increase of approximately 23% over the single primary ignition coil. While the absolute and relative advantages corresponding to the illustrated embodiment are indicative of the improvements over the prior art, the invention is not in any way restricted by their inclusion herein.

Figure 5:
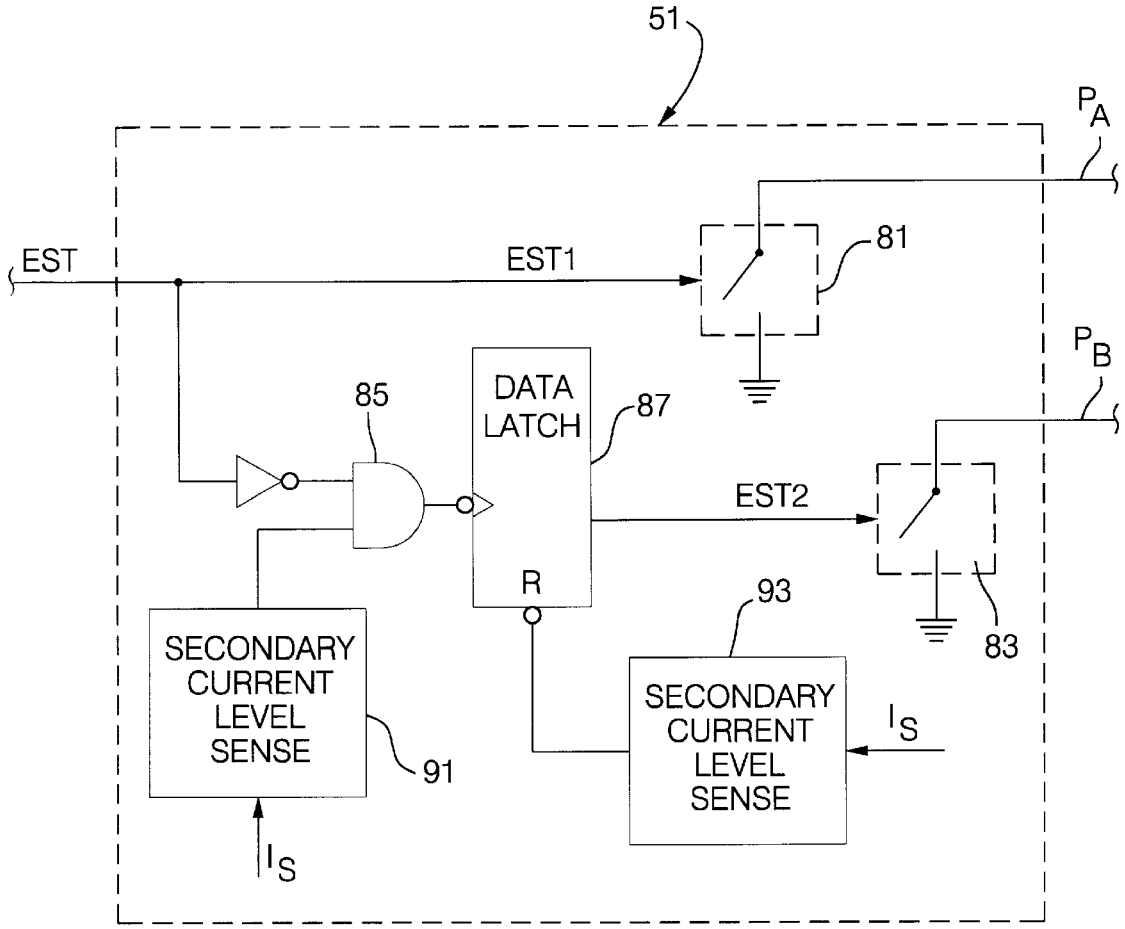
FIG. 5 is an electrical schematic of an alternate embodiment of the control circuit for implementing the multiple electrical discharges in accord with the present invention; and, FIGS. 6A and 6B are block diagrams of alternate circuitry for performing the energization and interruption sequencing of the second primary winding in accord with the circuit illustrated in FIG. 5.

Various alternative embodiments are illustrated in FIGS. 5 through 7 in block schematic format readily reducible to a variety of circuit reductions by one having ordinary skill in the art and the teachings contained herein. For example, FIG. 5 illustrates an alternative initiation and termination of the EST2 signal for energizing the second primary winding and subsequently interrupting the current, respectively. The first primary winding is shown selectively coupled to ground through a switch 81 controlled by the EST signal which comprises the EST1 signal in the control block 51. The EST signal is inverted and provided to AND gate 85 to disable the initiation of the energization of the second primary winding (setting of the EST2 signal) until the first primary winding current is interrupted (EST signal low). In this embodiment, the secondary winding current level is sensed at sensing circuit 91 and compared to a predetermined threshold to provide a high logic level signal indicating the desirability of energizing the second primary winding. It may be desirable to sense a predetermined level of secondary current from which the desired extension of burn may be achieved in a continuous burn application, or to ensure that the combustion arc has expired in a plasma induced misfire detection application. Therefore, data latch 87 would be set to a high logic level when EST is low and the secondary winding current level is sensed at the predetermined threshold. Similarly, in the case of a continuous burn application, the interruption of the current through the second primary winding may be caused to occur by sense and comparison of the secondary winding current to a predetermined minimum current threshold to avoid expiration of the combustion arc and continue the burn with an arc of opposite polarity as previously described. Secondary winding sensing circuit 93 therefore is adapted for providing a reset signal to data latch 87. The effect is similar to the previously detailed embodiment of circuit 51 wherein the data latch output provides the EST2 signal which in the present embodiment is set in accordance with the secondary winding current sense circuit 91 and reset in accordance with the secondary winding current sense circuit 93. EST2 signal then controls the state of switch 83 for grounding and opening the second primary winding.

Figure 6A:
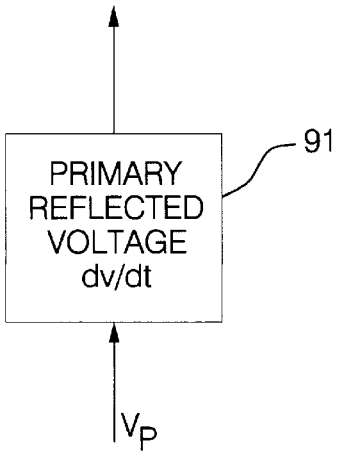
Figure 6B:
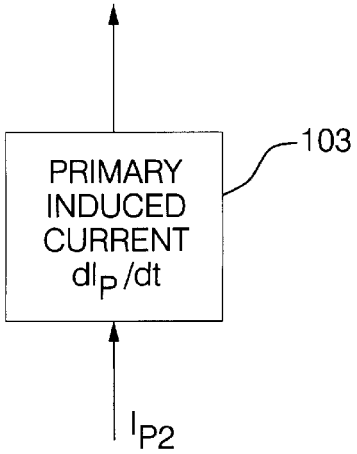

FIGS. 6A and 6B represent substitutable circuits for the energization and/or interruption signals supplied to the set and reset inputs of the data latch 87 of FIG. 5. In the instance of FIG. 6A, the circuit 101 detects the primary reflected voltage Vp across of one of the two primary windings and provides an output in accordance with a function of the time rate of change thereof. Generally, the primary reflected voltage time rate of change will be substantial upon the initiation of a combustion arc across the gapped electrodes. In the instance of FIG. 6B, the circuit 103 detects the primary winding induced current Ip2 through the second primary winding and provides an output in accordance with a function of the time rate of change thereof. Generally, the second primary winding current time rate of change will be substantial upon the expiration of the first combustion arc across the gapped electrodes. Preferably, the lower winding ratio (greater windings) second primary winding is used for such detection as the signal magnitude is substantially proportional to the windings thus providing a more robust signal-to-noise ratio for detection purposes.

While the present invention has been described with respect to certain preferred and alternate embodiments, those skilled in the art will recognize various alternatives are available for practicing the invention. therefore, the scope of the invention is intended to encompass such alternatives and modifications and to be limited only by the scope of the claims appended hereto.

We claim:

1. An apparatus for producing electrical arcs across a pair of gapped electrodes, comprising:

a secondary winding having a pair of output terminals coupled to the gapped electrodes;

a first primary winding inductively coupled to the secondary winding;

a second primary winding inductively coupled to the secondary winding;

the first and second primary windings being adapted such that energization of each respective primary winding establishes respective magnetic fields of opposite polarity; and, a circuit for sequentially energizing and deenergizing the first primary winding to establish a first electrical arc across the gapped electrodes followed by sequentially energizing and deenergizing the second primary winding to establish a second electrical arc across the gapped electrodes.

2. An apparatus for producing electrical arcs across a pair of gapped electrodes as claimed in claim 1 wherein the circuit energizes and deenergizes the second primary winding prior to the first electrical arc extinguishing.

3. An apparatus for producing electrical arcs across a pair of gapped electrodes as claimed in claim 1 wherein the circuit energizes the second primary winding subsequent to the deenergization of the first primary winding and deenergizes the second primary winding subsequent to the first electrical arc extinguishing.

4. An apparatus for producing electrical arcs across a pair of gapped electrodes as claimed in claim 3 wherein the energization of the second primary winding occurs prior to the first electrical arc extinguishing.

5. An apparatus for producing electrical arcs across a pair of gapped electrodes as claimed in claim 1 wherein the circuit senses current through the second primary winding and deenergizes the second primary winding when the sensed current reaches a predetermined threshold.

6. An apparatus for producing electrical arcs across a pair of gapped electrodes as claimed in claim 1 wherein the circuit senses current through the secondary winding and deenergizes the second primary winding when the sensed current reaches a predetermined threshold.

7. An apparatus for producing electrical arcs across a pair of gapped electrodes as claimed in claim 1 wherein the circuit energizes the second primary winding a predetermined delay time subsequent to the deenergization of the first primary winding.

8. An apparatus for producing electrical arcs across a pair of gapped electrodes as claimed in claim 1 wherein the circuit senses current through the secondary winding and energizes the second primary when the sensed current reaches a predetermined threshold subsequent to the deenergization of the first primary winding.

9. An apparatus for producing electrical arcs across a pair of gapped electrodes as claimed in claim 1 wherein the circuit comprises first and second current sense circuits for sensing current through the secondary winding, the first current sense circuit effective to energize the second primary winding when the sensed current reaches a first predetermined threshold subsequent to the deenergization of the first primary winding, and the second current sense circuit effective to deenergize the second primary winding when the sensed current reaches a second predetermined threshold.

10. An apparatus for producing electrical arcs across a pair of gapped electrodes as claimed in claim 1 wherein the circuit energizes the second primary winding a predetermined delay time subsequent to the deenergization of the first primary winding and senses current through the second primary winding to deenergize the second primary winding when the sensed current reaches a predetermined threshold.

11. A method of producing electrical arcs across a pair of gapped electrodes coupled to opposite ends of a secondary winding of an ignition coil, comprising the steps:

energizing a first primary winding of the ignition coil inductively coupled to the secondary winding of the ignition coil resulting in a magnetic field of a first magnetic polarity;

deenergizing the first primary winding to induce voltage of a first voltage polarity across the pair of gapped electrodes resulting in a first arc of a first arc polarity across the pair of gapped electrodes;

subsequent to the interruption of the energization of the first primary winding, energizing a second primary winding of the ignition coil inductively coupled to the secondary winding of the ignition coil resulting in a magnetic field of a second magnetic polarity opposite the first magnetic polarity; and, deenergizing the second primary winding to induce voltage of a second voltage polarity opposite the first voltage polarity across the pair of gapped electrodes resulting in a second arc of a second arc polarity across the pair of gapped electrodes opposite the first arc polarity.

12. The method of producing electrical arcs across a pair of gapped electrodes as claimed in claim 11 wherein the step of deenergizing the second primary winding occurs prior to the first arc extinguishing.

13. The method of producing electrical arcs across a pair of gapped electrodes as claimed in claim 11 wherein the step of deenergizing the second primary winding occurs subsequent to the first arc extinguishing.

14. The method of producing electrical arcs across a pair of gapped electrodes as claimed in claim 11 wherein the step of energizing the second primary winding occurs a predetermined delay time subsequent to the deenergization of the first primary winding.

15. The method of producing electrical arcs across a pair of gapped electrodes as claimed in claim 11 wherein the step of energizing the second primary winding occurs when the current through the secondary winding reaches a predetermined threshold subsequent to the deenergization of the first primary winding.

16. The method of producing electrical arcs across a pair of gapped electrodes as claimed in claim 11 wherein the step of deenergizing the second primary winding occurs when the current through the second primary winding reaches a predetermined threshold.

17. The method of producing electrical arcs across a pair of gapped electrodes as claimed in claim 11 wherein the step of energizing the second primary winding occurs when the current through the second primary winding reaches a first predetermined threshold subsequent to the deenergization of the first primary winding, and the step of deenergizing the second primary winding occurs when the current through the second primary winding reaches a second predetermined threshold.

18. The method of producing electrical arcs across a pair of gapped electrodes as claimed in claim 11 wherein the step of energizing the second primary winding occurs a predetermined delay time subsequent to the deenergization of the first primary winding, and the step of deenergizing the second primary winding occurs when the current through the second primary winding reaches a predetermined threshold.

* * * * *